United States Patent [19]

House

[11] Patent Number: 4,682,931

[45] Date of Patent: Jul. 28, 1987

[54] LIFT TRUCK CLAMP FOR HANDLING STACKED LOADS OF DIFFERENT SIZES

[75] Inventor: Marshall K. House, Portland, Oreg.

[73] Assignee: Cascade Corporation, Portland, Oreg.

[21] Appl. No.: 909,961

[22] Filed: Sep. 22, 1986

[51] Int. Cl.[4] ..... B66F 9/18

[52] U.S. Cl. ..... 414/623; 294/87.1; 294/88; 414/736

[58] Field of Search ..... 414/618, 619, 621, 623, 414/736; 294/87.1, 88, 106

[56] References Cited

U.S. PATENT DOCUMENTS

| | | | |
|---|---|---|---|
| 2,706,060 | 4/1955 | Ferrario et al. | 414/623 |
| 3,583,586 | 6/1971 | Burton | 414/623 |
| 3,990,594 | 11/1976 | Olson et al. | 414/619 |
| 4,127,205 | 11/1978 | Farmer et al. | 294/88 |
| 4,318,661 | 3/1982 | Helm | 294/87.1 |
| 4,397,495 | 8/1983 | Lewis | 294/88 |

FOREIGN PATENT DOCUMENTS

| | | | |
|---|---|---|---|
| 2578824 | 9/1986 | France | 294/2 |

*Primary Examiner*—Robert J. Spar
*Assistant Examiner*—Vien Q. Nguyen
*Attorney, Agent, or Firm*—Chernoff, Vilhauer, McClung & Stenzel

[57] ABSTRACT

A load clamp has two selectively openable and closable opposing clamping assemblies, one of which comprises at least a pair of clamp arms movable separately from each other toward and away from the other clamping assembly. Separate actuators for the respective clamp arms are controlled automatically in such a way that, during closure, the respective movements are simultaneous until such time as one of the arms attains a predetermined clamping force, at which time an override system permits their respective movements to become non-simultaneous to enable further closure of the other clamp arm. Corresponding actuator regulation occurs during opening of the clamp arms, the override function being triggered by full opening of one of the clamp arms.

16 Claims, 3 Drawing Figures

LIFT TRUCK CLAMP FOR HANDLING STACKED LOADS OF DIFFERENT SIZES

BACKGROUND OF THE INVENTION

The present invention is directed to a lift truck-mounted load-handling clamp adapted for handling stacked loads of different sizes simultaneously. More particularly, the invention is directed to a clamp for handling stacked paper rolls of abbreviated length, referred to as split paper rolls.

A relatively common requirement in the paper industry is the handling of split paper rolls which, because of their short length, are normally handled by a lift truck roll clamp in pairs having different diameters, stacked one atop the other. Lift truck paper roll clamps specially adapted for handling such stacked split rolls have been available in the past and consist of a pair of separately-actuated clamp arms on one side of the clamp, in opposed relation to a single, larger clamp arm assembly on the opposite side of the clamp. The separately-actuated arms give the clamp the ability to apply clamping force to two cylindrical objects of different diameters stacked one atop the other. Similar clamping capability can be required with respect to other types of loads, such as stacked bales or cartons of different sizes.

A problem common to such previous clamps is their inability to attain the required clamping force on one of the separately-actuated clamp arms without attaining it also on the other separately-actuated arm. Stated another way, the resistance to clamping force from a load engaged by one of the clamp arms must be matched by a corresponding resistance to clamping force on the other arm before any clamping force can be applied. For example, some of the prior split roll clamp structures merely have each separately-actuated arm powered by a separate hydraulic cylinder, the cylinders being connected in parallel to a source of pressurized fluid such that the pressure build-up in the two cylinders during clamping must be identical. The problem with such a structure is that, if only a single split roll is to be handled, clamping pressure on the roll-engaging arm cannot be attained until the other arm has closed to its maximum extent, which is very time-consuming. Conversely, on opening of the clamp arms to release a load, the release of both clamp arms is not usually simultaneous due to different frictional resistances in the respective arm mechanisms and, depending on the relative friction in each mechanism, may require full opening of one clamp arm before the other releases sufficiently to disengage the load, which is likewise time-consuming.

Certain alternative types of split roll paper clamps have been marketed in an attempt to solve these problems. These alternative designs operate on a common principle, i.e. a mechanical or hydraulic link is provided between the separately-actuated clamp arms which permits only a limit range of movement between the clamp arms, or between the respective load-engagement pads of the clamp arms. Such mechanical links include simple flexible or articulated tether-type links which prevent the unloaded arm from closing beyond a predetermined position relative to the loaded arm, such that the link supplies the resisting force to the unloaded clamp arm which would otherwise be provided by a load. This allows the required clamping pressure to be built up without complete closure of the unloaded arm. Comparable alternative structures employ either a mechanical or hydraulic balance beam principle between a pair of clamp arms or load-engagement pads, so that the extent to which the unloaded arm or pad must close before clamping pressure can be built up on the loaded arm or pad is likewise limited. All of these structures, however, share the common problem that they are capable of handling a pair of split rolls only if the respective diameters of the two rolls are within a predetermined range of each other corresponding to the limited range of movement permitted between the two arms. Moreover, they share the further problem that, when only a single split roll is handled, it is subjected to twice the clamping force that exists when a pair of rolls are handled since all reaction to the clamping force must be absorbed by the single roll. This places undue and possibly damaging stress on the single roll, as well as on the particular clamp arm or pad which is engaging the roll.

In many types of hydraulic mechanisms designed for a variety of purposes, it is common to use flow divider or combiner valves to regulate the flow of fluid to multiple actuators so as to cause them to move simultaneously and in proportion to each other. Such systems, however, are not adaptable to split paper roll clamps because the varying differences encountered between the diameters of pairs of stacked split rolls, as well as the requirement for engaging only a single split roll if necessary, require different proportions of movement between the respective clamp arms with each different load situation encountered. Flow divider and combiner valves are not readily adaptable to changeable proportions of movement.

Alternatively, it would be possible simply to control the actuation of each clamp arm through a separate directional control valve. However, such arrangement would require too many hydraulic lines passing from the lift truck to the vertically-reciprocating load clamp, and would require too many control valves for the lift truck operator to manipulate while simultaneously maneuvering the lift truck.

SUMMARY OF THE PRESENT INVENTION

The present invention solves the foregoing problems by providing separately-movable clamp arms controlled by separate actuators selectively movable, by operation of a single common direction control valve, toward and away from an opposing clamp arm assembly. The requirement of the prior art that the engagement pads of both clamp arms encounter some type of resistance to closing before clamping pressure can be built up in either one of them is eliminated by the provision of a regulator which requires the respective movements (or lack thereof) of the pair of clamp arms (or their load engagement pads) to be simultaneous. In the preferred embodiment, such regulator is a flow divider/combiner valve, although comparable hydraulic or electric regulators, in combination with hydraulic or electric actuators, can be used in equivalent structures However, such regulator is not used in the present invention in its normal manner, because the feature of the regulator which requires simultaneous movement or nonmovement of the arms at all times would make it impossible for the arms to achieve different degrees of closure with respect to each other to conform to the varying differences between the respective sizes of different combinations of stacked loads. Accordingly, the present invention further provides means for automatically overriding the normal function of the regulator at the appropriate times. During closing of the clamp arms, the overriding function occurs automatically in response to the attainment of a predetermined clamping force by one of the clamp arms, the overriding function permitting the other clamp arm to continue closing even though the first clamp arm can close no further. This is accomplished while maintaining the predetermined clamping force on the first clamp arm.

Conversely, upon opening of the clamp arms, the regulator requires simultaneous opening movement of the clamp arms so that they simultaneously release their clamped loads, but an overriding function permits the further opening of one arm when the other arm can open no further.

The above-described combination of the regulator and override system enables one clamp arm to engage a split paper roll or other type of load, such as a bale or carton, during closing and to apply full clamping pressure thereto immediately without any requirement that the other clamp arm close further or encounter any resistance to closing. However, if desired, the other clamp arm can be closed further into engagement with a smaller, second roll or other load while clamping pressure is maintained by the first clamp arm. Conversely, upon opening, both clamp arms simultaneously release their respective loads. Engagement and disengagement of single or plural loads, and disengagement therefrom, are thus accomplished quickly and effectively regardless of the extent of the difference in size of the plural loads, and regardless of the complete absence of a load.

The invention is applicable to load clamps of all types, whether using pivotal arms or sliding arms, and for all types of loads whether of cylindrical or other shape.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
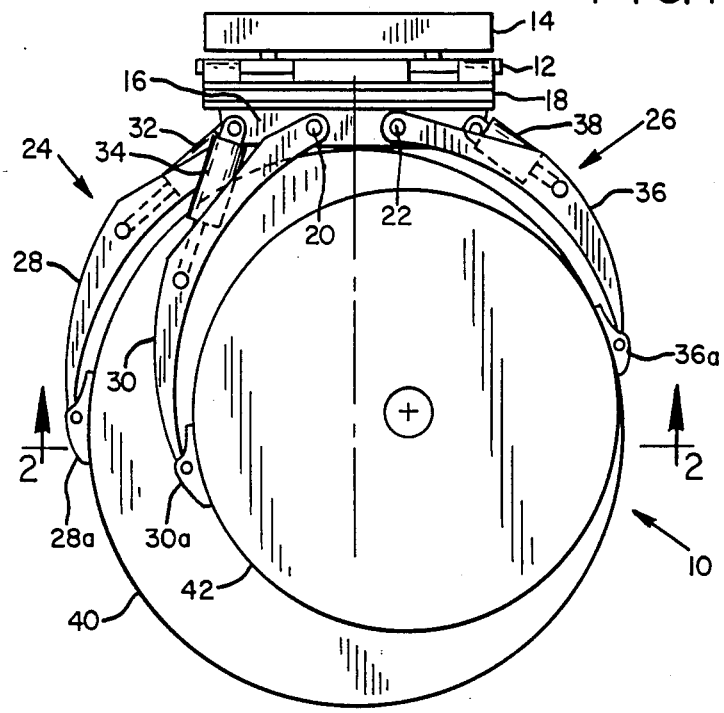
FIG. 1 is a simplified top view of an exemplary split paper roll clamp embodying the present invention, shown in engagement with a pair of stacked, split rolls of different diameters.

An exemplary split paper roll clamp, designated generally as 10 in FIG. 1, is mounted on a vertically-reciprocating carriage 12 carried by a lift truck mast 14. The load clamp comprises a frame 16 mounted on the load carriage 12 connected either fixedly thereto or, as shown in FIG. 1, by a rotator assembly 18. Pivotally mounted to the frame 16 at pivot points 20, 22 are a pair of opposed clamping assemblies designated generally as 24 and 26. The clamping assembly 24 comprises a pair of vertically-spaced clamp arms 28 and 30, having respective load engagement pads **28*a* and 30*a*, movable separately from each other relative to the frame 16 selectively toward and away from the opposed clamping assembly 26 under the control of fluid power actuators 32 and 34 respectively, each consisting of a double-acting hydraulic cylinder connected between the frame 16 and the respective clamp arm 28 or 30. The opposed clamping assembly 26, on the other hand, consists of only a single clamp arm 36 having an elongated load engagement pad 36*a* extending vertically so as to oppose the pads of both of the clamp arms 28 and 30. The clamp arm 36 pivots with respect to the frame 16 under the control of a further fluid power actuator 38. Alternatively, the arm 36 could be fixed with respect to the frame 16**.

The function of the load clamp 10 is to engage multiple split paper rolls, such as 40 and 42, of varying different diameters simultaneously so as to transport them from one location to another. It is also necessary that the clamp be capable of engaging and carrying only a single split paper roll, such as roll 40. Carrying of the rolls requires that each be engaged with sufficient clamping force, by the respective pads **28*a*, 30*a* and 36*a*, to be able to support the weight of the loads vertically. The clamping force with respect to pads 28*a* and 3O*a* is supplied by the pressure of hydraulic fluid tending to extend hydraulic cylinders 32 and 34**, respectively.

The control of cylinders 32 and 34 will be explained with reference to FIG. 3. A hydraulic pump 44, driven by the lift truck engine, delivers fluid under pressure from a hydraulic reservoir 46 to a manually-operable clamp arm directional control valve 48 shown in its centered, or unactuated, condition. A relief valve 50 sets an upper limit on the pressure of the fluid delivered by pump 44 by opening and bleeding fluid back to the reservoir 46 in response to excessive fluid pressure as determined by the variable setting of the relief valve 50.

Figure 3:
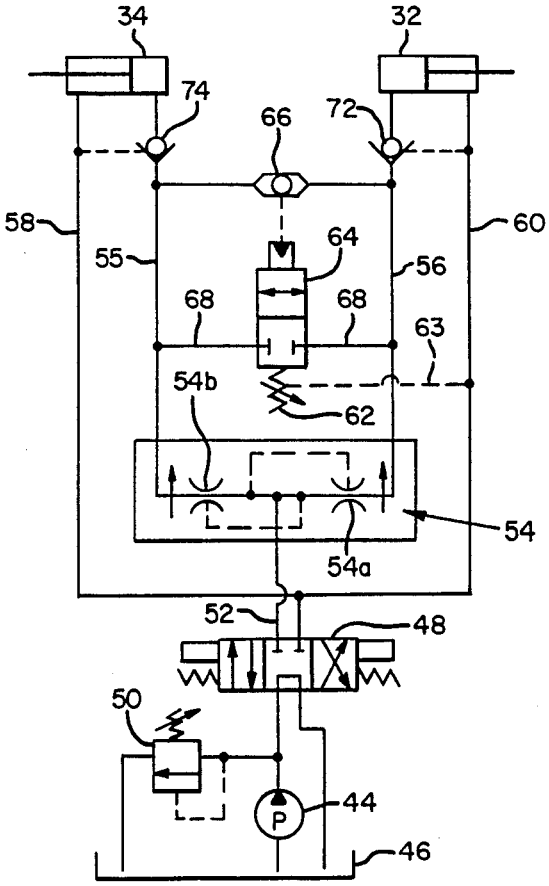
FIG. 3 is a hydraulic circuit diagram of the preferred embodiment of the present invention.

Closing of the clamp arms 28 and 30 is accomplished by the lift truck operator's manipulation of valve 48 so as to move its spool to the right as shown in FIG. 3. This delivers pressurized fluid to the input conduit 52 of a conventional flow divider/combiner valve 54 (such as that manufactured by Modular Controls of Villa Park, Ill. under Model No. FDC1-10-0-33). The purpose of the valve 54 is to split the flow in input line 52 into a pair of emerging flows in lines 55 and 56 to ensure that the hydraulic cylinders 32 and 34 extend simultaneously, and thus that the clamp arms 28 and 30 advance simultaneously toward the opposed clamp arm assembly 36. The valve 54 causes the respective volumetric flow rates in conduits 55 and 56 to be proportional to each other and, assuming that the cylinders 32 and 34 are of the same diameter, preferably equal to each other. While the cylinders 32 and 34 are thus being extended, fluid from the rod end of each cylinder is being exhausted through a respective conduit 60, 58, and through the directional control valve 48 to the reservoir 46.

Assuming that rolls of different diameters corresponding to rolls 40 and 42 are to be engaged, clamp arm 28 would normally be the first to encounter resistance from the larger diameter roll 40. This resistance develops a higher pressure in conduit 56 than in conduit 55, and reduces the flow across restrictor **54*a* of the valve 54. In response thereto, the valve 54 reduces restriction 54*b* to accomplish a corresponding reduction in flow through restriction 54*b*. When flow through restrictor 54*a* ceases due to the inability of the cylinder 32 to extend further, restrictor 54*b* is substantially closed, thereby likewise preventing further extension of cylinder 34 and further closure of clamp arm 30. At this point the clamp arm 30 has not yet engaged the smaller diameter roll 42. However, by continued actuation of the directional control valve 48 tending to close the clamp arms, the fluid pressure in conduit 56 builds up to that which corresponds to a predetermined clamping force adjustably set by spring 62 of an overriding sequence valve 64. When the pressure in line 56, acting on valve 64 through shuttle valve 66, overcomes the force of spring 62, the overriding sequence valve 64 opens creating a shunt between cylinders 32 and 34 through conduit 68. This permits fluid to flow from conduit 56 to conduit 55 and thereby further extend cylinder 34 and close clamp arm 30. The opening of valve 64 permits further flow through restrictor 54***a* and thus causes valve 54 to open restrictor 54*b* to the extent that the flows through both restrictors are proportional, but with all of the flow being delivered to conduit 55. While valve 64 is open, the predetermined clamping force is maintained on clamp arm 28 by a pilot operated check valve 72, but even in the absence thereof the clamping force would be maintained by the maintenance of the pressure in conduit 56 necessary to keep the sequence valve 64 open. Cylinder 34 continues to extend until encountering the resistance of roll 42, at which time clamping force is applied and the pressure in conduit 55 rises to a level equal to that in conduit 56, after which the directional control valve 48 may be centered and the rolls lifted. Relief valve 50 is set to open at a pressure sufficiently above that set by spring 62 of the sequence valve 64 (for example at least 100 psi higher) to insure that system pressure can always open the sequence valve, but sufficiently low to prevent damaging excessive clamping pressure on the rolls by continued actuation of the control valve 48. The exposure of the spring 62 to conduit 60 through drain line 63 during the foregoing operation does not effect the operation of the sequence valve 64 since conduit 60 is under low pressure when exhausting fluid during clamp arm closure.

It will be recognized by those skilled in the art that equivalent circuits to that just described could perform a like function. For example the flow divider valve 54 could be replaced with a pair of interconnected rotary flow regulators to ensure simultaneous flow through both conduits 55 and 56. Moreover, although the regulator 54 is shown interposed between the source of pressurized fluid and the cylinders, it could alternatively be interposed in the exhaust conduits 58, 60, operating in a combining mode so as to require simultaneous exhaust flows from the cylinders 32 and 34, since controlling the exhaust of a double-acting cylinder is effective to control its input.

If only a single roll 40 were present, the clamp closing operation could be halted by deactivation of control valve 48 as soon as sufficient clamping pressure had been built up in conduit 56 upon initial engagement with the roll 40, and there would be no need to further extend cylinder 34 to further close clamp arm 30.

The override valve 64 is responsive to the attainment of the predetermined clamping force by either one of the clamp arms 28 and 30 by virtue of its ability to sense pressure in either conduit 55 or conduit 56 through shuttle valve 66. Thus it would make no difference if the clamp 10 had been inverted by rotator 18 such that the clamp arm 30 is in the lower position for engaging roll 40. In such case the operation of arm 30 would be identical to that just described with respect to arm 28, and vice versa.

When the load is to be disengaged, the operator moves the spool of the control valve 48 to the left in FIG. 3, such that pressurized fluid from pump 44 is directed to the rod end of each hydraulic cylinder 32, 34. Pilot-operated check valves 72 and 74 are unseated by the pressure in conduits 60 and 58, respectively, such that fluid can be exhausted simultaneously from the cylinders through conduits 55 and 56. Valve 54, acting now as a combiner valve, requires simultaneous flows through conduits 55 and 56 and, if such flows are not simultaneous and proportional, reduces the size of the restriction 54*a* or 54*b* having excessive flow. This has the effect of raising system pressure to the point necessary to effect retraction of the nonmoving cylinder by overcoming frictional or other forces which are tending to hold it back. Accordingly the valve 54, acting in its combining mode, causes substantially simultaneous release of the two clamp arms 28 and 30.

Figure 2:
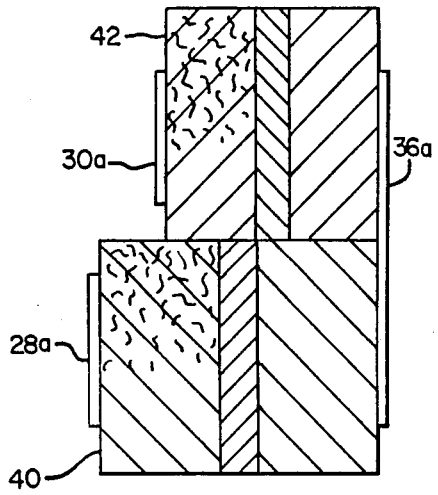
FIG. 2 is a reduced, simplified sectional view taken along line 2—2 of FIG. 1.

If, upon the initiation of opening, the clamp arms are in different positions as shown, for example, in FIGS. 1 and 2, the clamp arms will open simultaneously maintaining their different positions as long as the operator actuates the control valve 48. When one clamp arm, such as 28, has reached the full extent of its opening range, there can no longer be any flow exhausted from its cylinder 32 through restriction 54*a*. Accordingly, the valve 54 tends to close the opposite restriction 54*b*, likewise blocking the exhaust from cylinder 34, because of its requirement for simultaneous flows from the two cylinders. However, if it is desired that cylinder 34 be further retracted, the valve 54 can be overridden by the operator's continued actuation of control valve 48. Although not shown in FIG. 3, one way to override the valve 54 in its combining mode would be to do so in substantially the same manner that it is overridden in its arm-closing, dividing mode, i.e. provide a second shunting sequence valve such as 64 between the conduits 55 and 56 having a lower opening pressure setting than valve 64 and responsive to pressure from a second shuttle valve such as 66 interconnecting conduits 58 and 60. However, a simpler and more economical override system is used in FIG. 3 which relies merely on the ability of a conventional flow divider/combiner valve such as 54 to permit opening of the restrictors 54*a*, 54*b*, when in its combining mode, in response to pressure in conduit 55 or conduit 56 exceeding a predetermined limit.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of fluid power actuators, each associated with a respective clamp arm, for moving said clamp arms separately from each other selectively toward and away from the second clamping assembly;

(d) a source of pressurized fluid connected to said pair of fluid power actuators for selectively causing said actuators to move said clamp arms toward said second clamping assembly by the supply of respective flows of fluid to said actuators;

(e) flow-regulating means connected to said pair of actuators for regulating said respective flows of fluid so as to cause the respective movements of said pair of clamp arms, in a direction toward said second clamping assembly, to be simultaneous with each other; and (f) override means for overriding said flow-regulating means, automatically in response to the attainment of a predetermined clamping force by one of said pair of clamp arms, by permitting the other of said pair of clamp arms to move in a direction toward said second clamping assembly without simultaneous movement in said direction by both of said pair of clamp arms.

2. The apparatus of claim 1 wherein said override means includes means for overriding said flow-regulating means automatically in response to the attainment of a predetermined clamping force by either one of said pair of clamp arms.

3. The apparatus of claim 1 wherein said override means comprises valve means for selectively creating a shunt between said pair of fluid power actuators bypassing said flow-regulating means in response to said attainment of said predetermined clamping force.

4. The apparatus of claim 1 wherein said override means includes means for sensing the pressure of fluid supplied by said source of pressurized fluid to the actuator associated with said one of said pair of clamp arms for sensing the attainment of said predetermined clamping force by said one of said pair of clamp arms.

5. The apparatus of claim 1 wherein said flow-regulating means comprises means interposed between said pair of fluid power actuators and said source of pressurized fluid for supplying fluid from said source to said actuators at respective volumetric flow rates proportional to each other.

6. The apparatus of claim 1, including further flow-regulating means connected to said pair of actuators for causing the respective movements of said pair of clamp arms, in a direction away from said second clamping assembly, to be simultaneous with each other, and including further override means for overriding said further flow-regulating means, automatically in response to the attainment of a predetermined extent of opening by one of said pair of clamp arms, by permitting the other of said pair of clamp arms to move in a direction away from said second clamping assembly without simultaneous movement away from said second clamping assembly by both of said pair of clamp arms.

7. The apparatus of claim 6 wherein said further override means includes means for overriding said further flow-regulating means automatically in response to the attainment of a predetermined extent of opening by either one of said pair of clamp arms.

8. The apparatus of claim 6 wherein said further flow-regulating means comprises means connected to said pair of fluid power actuators for exhausting fluid from said actuators at respective volumetric flow rates proportional to each other.

9. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of power actuators, each associated with a respective clamp arm, for moving said clamp arms separately from each other selectively toward and away from the second clamping assembly;

(d) regulating means connected to said pair of actuators for regulating the respective movements of said actuators so as to cause the respective movements of said pair of clamp arms, in a direction toward said second clamping assembly, to be simultaneous with each other; and (f) override means for overriding said regulating means, automatically in response to the attainment of a predetermined clamping force by one of said pair of clamp arms, by permitting the other of said pair of clamp arms to move in a direction toward said second clamping assembly without simultaneous movement in said direction by both of said pair of clamp arms.

10. The apparatus of claim 9 wherein said override means includes means for overriding said regulating means automatically in response to the attainment of a predetermined clamping force by either one of said pair of clamp arms.

11. The apparatus of claim 9 including further regulating means connected to said pair of actuators for regulating the respective movements of said actuators so as to cause the respective movements of said pair of clamp arms, in a direction away from said second clamping assembly, to be simultaneous with each other and including further override means for overriding said further regulating means, automatically in response to the attainment of a predetermined extent of opening by one of said pair of clamp arms, by permitting the other of said pair of clamp arms to move in a direction away from said second clamping assembly without simultaneous movement away from said second clamping assembly by both of said pair of clamp arms.

12. The apparatus of claim 11 wherein said further override means includes means for overriding said further regulating means automatically in response to the attainment of a predetermined extent of opening by either one of said pair of clamp arms.

13. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of fluid power actuators, each associated with a respective clamp arm, for moving said clamp arms separately from each other selectively toward and away from the second clamping assembly;

(d) a source of pressurized fluid connected to said pair of fluid power actuators for selectively causing said actuators to move said clamp arms toward said second clamping assembly by the supply of respective flows of fluid to said actuators;

(e) a single directional control valve for controlling the supply of said respective flows of fluid to both of said pair of actuators; and (f) flow-regulating means connected to said pair of actuators for enabling one of said pair of clamp arms to apply a predetermined clamping force in a direction toward said second clamping assembly substantially without any resistance to movement in said direction imposed upon the other of said pair of clamp arms and, alternatively, enabling both of said pair of clamp arms to apply said predetermined clamping force simultaneously.

14. The apparatus of claim 13 wherein said flow-regulating means includes means for enabling either one of said pair of clamp arms to apply said predetermined clamping force substantially without any resistance to movement in said direction imposed upon the other of said pair of clamp arms.

15. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of power actuators, each associated with a respective clamp arm, for moving said clamp arms separately from each other selectively toward and away from the second clamping assembly;

(d) a single controller for controlling both of said pair of power actuators simultaneously so as to selectively control the movement of said clamp arms; and (e) regulating means connected to said pair of actuators for enabling one of said pair of clamp arms to apply a predetermined clamping force in a direction toward said second clamping assembly substantially without any resistance to movement in said direction imposed upon the other of said pair of clamp arms and, alternatively, enabling both of said pair of clamp arms to apply said predetermined clamping force simultaneously

16. The apparatus of claim 15 wherein said regulating means includes means for enabling either one of said pair of clamp arms to apply said predetermined clamping force substantially without any resistance to movement in said direction imposed upon the other of said pair of clamp arms.

* * * * *